United States Patent [19]

Schwartz

[11] 3,942,497

[45] Mar. 9, 1976

[54] FUEL INJECTION SYSTEM

[75] Inventor: Reinhard Schwartz, Stuttgart, Germany

[73] Assignee: Robert Bosch GmbH, Stuttgart, Germany

[22] Filed: Oct. 29, 1974

[21] Appl. No.: 518,988

[30] Foreign Application Priority Data

Nov. 16, 1973 Germany ..... 2357263

[52] U.S. Cl. ..... 123/139 AW; 123/139 AL

[51] Int. Cl.[2] ..... F02M 39/00

[58] Field of Search ..... 123/139 AW, 139 AL

[56] References Cited

UNITED STATES PATENTS

| | | | |
|---|---|---|---|
| 3,703,888 | 11/1972 | Eckert | 123/139 AW |
| 3,817,229 | 6/1974 | Stumpp | 123/139 AW |
| 3,842,813 | 10/1974 | Eckert | 123/139 AW |

*Primary Examiner*—Charles J. Myhre
*Assistant Examiner*—Ronald B. Cox
*Attorney, Agent, or Firm*—Edwin E. Greigg

[57] ABSTRACT

A fuel injection system for mixture compressing, externally ignited internal combustion engines includes a fuel distributing unit having a plurality of fuel metering valves, and a plurality of pressure valves. The pressure valves are disposed in the fuel flow path between their respective fuel metering valve and their associated fuel injection valve. Each of the pressure valves includes a space which is divided into first and second chambers by a flexible member. At least one of the pressure valves is embodied as an equal pressure valve, and at least one of the pressure valves is embodied as a differential pressure control valve. The pressure in the second chamber of the differential pressure control valve is the pressure prevailing upstream of the fuel metering valves, and the first chamber of the differential pressure control valve communicates with the second chamber of each of the equal pressure valves so that the pressures therein are equal. Fuel metering occurs at a constant pressure difference.

7 Claims, 4 Drawing Figures

FUEL INJECTION SYSTEM

BACKGROUND OF THE INVENTION

The present invention relates to a fuel injection system for mixture compressing, externally ignited internal combustion engines, and more particularly to such a system including fuel injection valves, and a fuel distribution unit with fuel metering valves which determine the fuel quantity flowing into the injection valves by jointly changing their flow cross section. The metering process in such a system occurs at a constant pressure difference. Disposed in each fuel flow path downstream of the fuel-metering valves is a valve, whose flow cross section can be changed by a flexible member. The flexible member for each valve separates two chambers in the valve with the pressure in the first chamber of each valve being the fuel pressure prevailing downstream of the metering valve. This pressure acts on the flexible member in the opening direction of the valves.

Such fuel injection systems are designed for the purpose of using the magnitude of a setting parameter which acts on the fuel metering valve and which corresponds to the operational conditions of the internal combustion engine in order to achieve an appropriate change in the flow cross section of the downstream valves and also, with the aid of as constant a pressure gradient as possible across this flow cross section, to achieve a constantly precise metering of fuel corresponding to the particular open cross section of the downstream valves and one which is independent of the pressures prevailing before and behind this metering location.

In a known fuel injection system of this kind, the fuel for the individual cylinders of the internal combustion engine is metered out in common by a fuel metering valve. The fuel metering valve has a different control slit for each engine cylinder and a control slide having a control edge operatively associated with the different control slits. In this system, the fuel metering takes place at a pressure difference which is held constant by equal pressure valves. The pressure difference can, however, be changed in dependence on engine parameters, and the control pressure acting on the equal pressure valves is adjustable by means of a control pressure valve.

A fuel injection system so designed requires both a supply circuit and a control pressure circuit. Furthermore, a supplementary control pressure valve is required for each cylinder of the internal combustion engine in addition to the equal pressure valves.

OBJECTS AND SUMMARY OF THE INVENTION

It is, therefore, an object of the present invention to provide the existing state-of-the-art with an improved fuel injection system of the type discussed above.

It is another object of the present invention to provide the existing state-of-the-art with a fuel injection system of the type discussed above which requires a low constructional expenditure.

These and other objects are achieved according to the present invention by the provision of a fuel injection system having a fuel metering valve, at least one valve embodied as an equal pressure valve and at least one valve embodied as a differential pressure control valve, wherein both the equal pressure valve and the differential pressure control valve have two chambers each, with the fuel pressure upstream of the metering valve prevailing in the second chamber of the differential pressure control valve, and with the first chamber of the differential pressure control valve being in communication with the second chamber of each of the equal pressure valves.

An advantageous embodiment of the present invention provides that the pressure difference prevailing at the metering valve is changeable in dependence on engine parameters by means of the differential pressure control valve.

Another advantageous embodiment of the present invention provides that the equal pressure valve is embodied as a flat seat valve with a diaphragm as its flexible member.

A further advantageous design of the present invention consists in that the differential pressure control valve is a flat seat valve with a diaphragm as its flexible member which is loaded in its opening direction by a spring having a low spring constant.

BRIEF DESCRIPTION OF THE DRAWING

Two exemplary embodiments of the invention are shown in simplified form in the drawing and are described in detail below. In the drawing.

DESCRIPTION OF THE PREFERRED EMBODIMENTS

Figure 1:
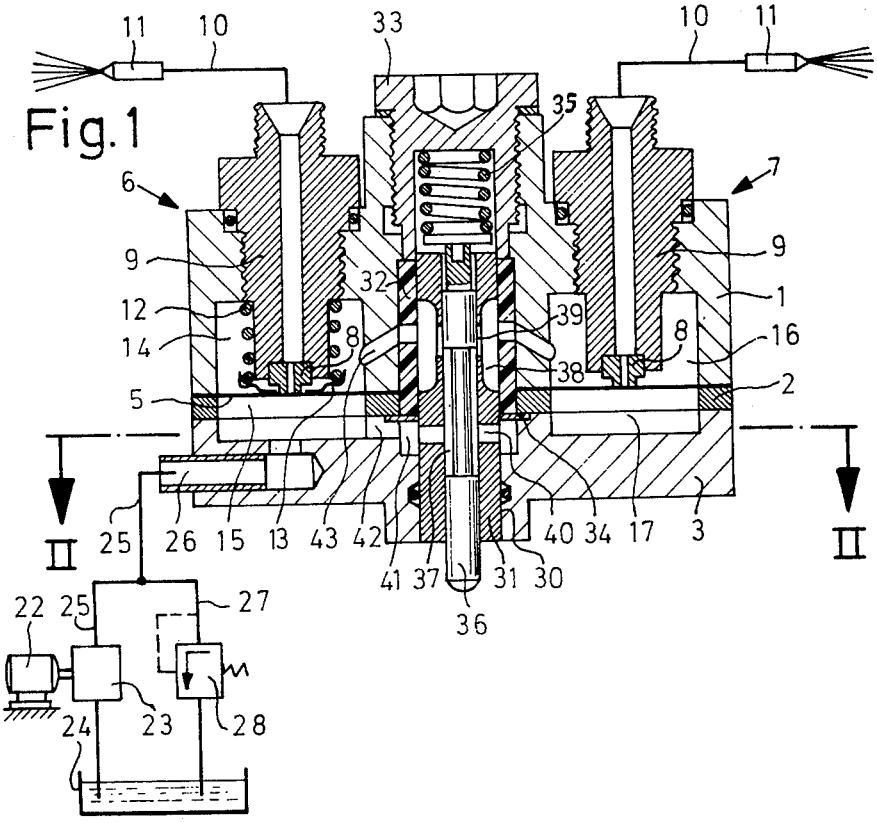
FIG. 1 is an axial sectional view of a first exemplary embodiment of the fuel injection system according to the present invention.
Figure 2:
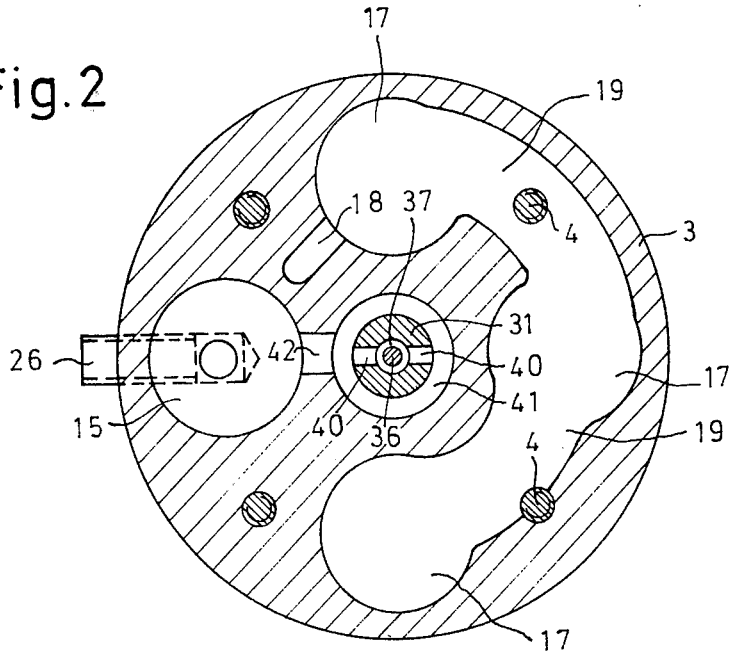
FIG. 2 is a cross section along the line II—II in FIG. 1.
Figure 3:
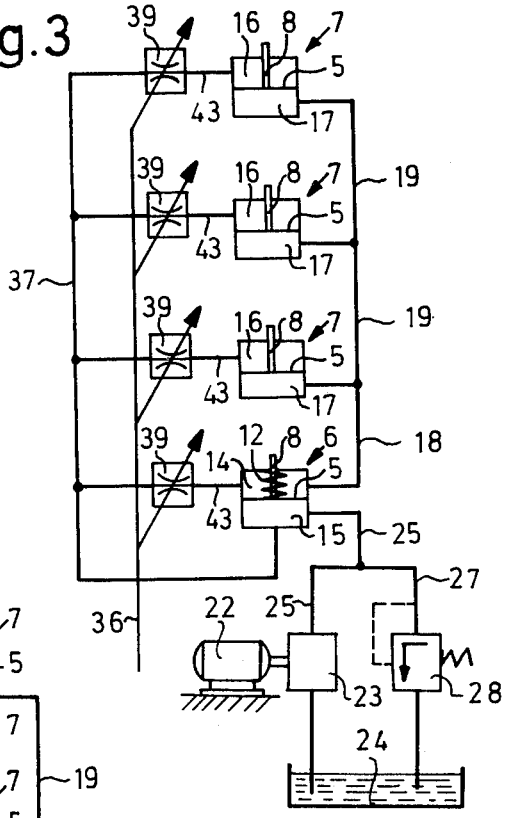
FIG. 3 is a schematic representation of the first exemplary embodiment of the fuel injection system according to the present invention.

The exemplary embodiment of the fuel injection system according to FIGS. 1, 2 and 3 is for a four cylinder internal combustion engine. The system has a housing 1, an intermediate plate 2, and a bottom cover 3 all axially compressed and joined into an assembly by screws 4. Clamped between the housing 1 and the intermediate plate 2 is a diaphragm 5. The diaphragm 5 serves to divide axial bores 14, 15 and 16, 17, uniformly distributed about the longitudinal axis of the housing, into chambers 14, 15 and 16, 17. The diaphragm 5 also serves as the diaphragm for diaphragm valves 6 and 7. Because this exemplary embodiment relates to a fuel distributing system for a four-cylinder internal combustion engine, there are four diaphragm valves of which one is a differential pressure control valve 6 and the other three valves are equal pressure valves 7. Each of these valves includes a valve seat carrier 9 which has a valve seat 8 connected thereto. The diaphragm 5, together with the fixed valve seat 8, forms a flat seat valve. The valve seat carrier 9, which is screwed into the housing 1, also serves as a connecting member for fuel lines 10 which lead to fuel injection valves 11. Supported on the valve seat carrier 9 of the differential pressure control valve 6 is a helical spring 12 which has as low a spring constant as possible. This helical spring 12 loads the diaphragm 5 in the opening direction of the valve 6 via a spring support 13, so that, when not in operation, the differential pressure control valve 6 is opened. The diaphragm 5 serves, firstly as stated above, to separate a first chamber 14 from a second chamber 15 in the differential pressure control valve 6 and, secondly, to separate the first chambers 16 from the second chambers 17 within the equal pressure valves 7. A channel 18 leads from the first chamber 14 of the differential pressure control valve 6 to the second chamber 17 of an equal pressure valve 7. The second chambers 17 of the equal pressure valve 7 are all mutually connected by an annular channel 19 (FIG. 2).

Fuel is supplied from a fuel tank 24 by a fuel pump 23 through a line 25 and a connecting member 26 into the second chamber 15 of the differential pressure control valve 6. The fuel pump 23 is driven by an electric motor 22. Branching off from the line 25 is a line 27 containing a pressure limiting valve 28 which permits fuel to flow back into the fuel tank 24 when the fuel system pressure becomes too high.

An axial bore 30 formed in the housing 1, the intermediate plate 2 and the bottom cover 3 of the fuel distributing system has a guide bushing 31 mounted therein. An elsatic sealing sleeve or liner 32, which may consist of rubber, is also mounted within the bore 30. The sleeve 32 secures the guide bushing 31 against axial and rotational displacement and, for this purpose, the sealing sleeve or liner 32 is axially compressed by a plug 33 against a disc 34. The plug 33 is threadedly engaged within the bore 30 formed by the upper portion of the housing 1, while the disc 34 is located in the bore 30 between the bottom cover 3 and the intermediate plate 2. A further result of this is that no fuel can leak either between the guide bushing 34 and the housing 1 or between the housing 1 and the intermediate plate 2.

A control slide 36 is provided which is axially displaceable within the guide bushing 31 against the force of a spring 35, the control slide 36 has formed therein an annular groove 37. The restoring force acting on the control slide 36 could be provided by pressurized fluid instead of by the spring 35. This pressurized fluid would act upon the control slide under the control of a hydraulic control pressure system (not shown). The guide bushing 31 has longitudinal grooves 38 which communicate with the interior bore of the guide bushing 31 through exactly identical, axially parallel, longitudinal slits 39 (control slits) or control bores. The control slide 36 along with the annular groove 37 form a plurality of fuel metering valves with the control slits 39. Thus, depending on the position of the control slide 36, the annular groove 37 opens up or uncovers a section of the control slits 39 of greater or lesser length. The guide bushing 31 also contains radial bores 40 which constitute a constant communication between the annular groove 37 and an annular channel 41 disposed in the bottom cover 3. The annular channel 41 is connected to the second chamber 15 of the differential pressure control valve 6 by a channel 42. Each of the longitudinal grooves 38 in the guide bushing 31 is connected through one of the channels 43 with the first chamber 14 of the differential pressure control valve 6 or with the first chambers 16 of the equal pressure valve 7. Associated with each valve 6, 7, therefore, is a longitudinal groove 38 and its control slit 39. The first chambers 14 or 16 are thereby separated from one another.

The method of operation of the fuel injection system described is as follows:

The fuel delivered by the fuel pump 23 flows through the line 25 and the connecting member 26 into the second chamber 15 of the differential pressure control valve 6 and thence through a channel 42, an annular channel 41 and radial bores 40 into the annular groove 37 of the control slide 36. The control slide 36 may be displaced in the axial direction, for example, by an air-measuring member (not shown) disposed in the induction tube of the internal combustion engine, so that the annular groove 37 opens the control slits 39 to a greater or lesser degree. From the annular groove 37, fuel metered through the control slits 39 flows into the longitudinal grooves 38 and thence through channels 43 into the first chamber 14 of the differential pressure control valve 6 or the first chambers 16 of the equal pressure valves 7. The first chamber 14 of the differential pressure control valve 6 communicates through the channel 18 with the second chambers 17 of the equal pressure valves 7 which are in mutual connection through the annular channel 19.

The rigidity of the diaphragm 5 and the force of the spring 12 of the differential pressure control valve 6 are so chosen that when the intended pressure gradient between the first chamber 14 and the second chamber 15 changes, then the flow cross section existing between the diaphragm 5 and the valve seat 8 is changed until the intended pressure gradient is again reached. In the flat seat valves shown, this can be done in an extraordinarily short period of time, because, even with a very small stroke of the diaphragm 5, the flow cross section is greatly changed. The force of the spring 12, on the other hand, is only slightly changed, due to the small stroke, so that the regulating mechanism may operate very precisely, i.e., the pressure gradient is nearly constant independently of the fuel flow rate.

Throttling of the fuel at the control slits 39 is very nearly equal, so that an approximately equal fuel pressure prevails in the first chamber 14 of the differential pressure control valve 6 and the first chambers 16 of the equal pressure valves 7. Moreover, due to the connection of the first chamber 14 of the differential pressure control valve 6 with the second chambers 17 of the equal pressure valves 7, approximately the same fuel pressure prevails in the second chambers during regulation as prevails in the first chambers 16. The use of equal pressure valves 7 provides an advanatage in that, for the desired pressure difference to prevail at the metering valve 36, 37, 39, it is only necessary to properly choose the spring 12 of the differential pressure control valve 6, whereas such a tuning is unnecessary at the individual equal pressure valves 7. Thus, in contrast to known fuel injection systems of this kind, an advantage is achieved in that a separate control pressure circuit including the control pressure valve is unnecessary.

Figure 4:
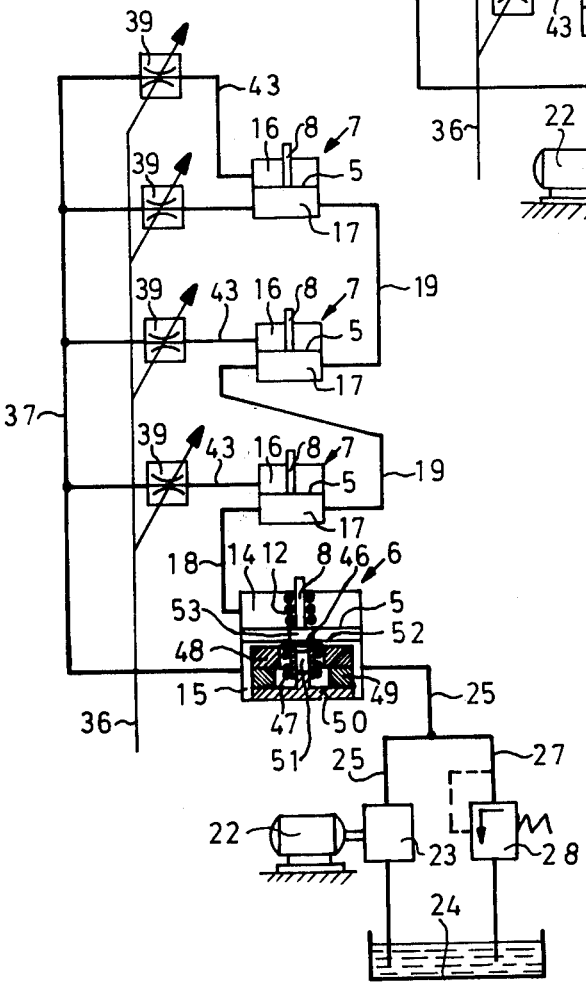
FIG. 4 is a schematic representation of a second exemplary embodiment of the fuel injection system according to the present invention.

In FIGS. 3 and 4, identical parts have retained the same reference numerals used in the previously described first exemplary embodiment. The second exemplary embodiment shown in FIG. 4 is different from the first exemplary embodiment in that the fuel flowing through the differential pressure control valve 6 to the injection valve 11 constantly flows through the second chambers 17 of the equal pressure valves 7. This is done by first passing the corresponding metered out fuel quantity through the second chambers 17 of the equal pressure valves 7 and only then into the first chamber 14 of the differential pressure control valve 6. Such a design offers the advantage that the air bubbles which might accumulate underneath the diaphragm 5 are flushed away.

Furthermore, according to the embodiment of FIG. 4, the possibility of changing the differential pressure prevailing at the metering valve 36, 37, 39 by changing the force of the spring 12 in the differential pressure control valve 6 exists. Such a change of the pressure difference at the metering valve may be necessary to adapt the fuel-air mixture to the operational conditions of the internal combustion engine. Thus, it is suitable to make such a change in the differential pressure in dependence on engine parameters. This does not mean, however, that the differential pressure prevailing at the metering valve is to be constantly changing, but only that the differential pressure is to be altered to a different value and then to be held constant again at that new value. A change in the force of the spring 12 in the differential pressure control valve 6 can take place for example, in that an electromagnetic assembly, including a moving coil armature 46, a coil 47, a soft iron core 48, a permanent magnet 49, and a soft iron plate 50, is disposed within the second chamber 15. The soft iron plate 50 has a core 51 which extends into the moving coil armature 46 suspended from a leaf spring 52. The connection between the leaf spring 52 and the diaphragm 5 is made by an intermediate member 53. The pressure difference prevailing at the metering valve can be regulated, for example, based on the oxygen content of the exhaust gas of the internal combustion engine. For this purpose, a socalled oxygen sensor (not shown) is suitably employed which may be disposed in the exhaust line of the internal combustion engine, and which, acting via an electric circuit, changes the strength of the current flowing through the coil 47 of the electromagnet assembly. As a result, the moving coil armature 46 is attracted magnetically, to a greater or lesser degree, toward the core 51, i.e., in the direction of unloading the spring 12. The change of the pressure difference prevailing at the differential pressure control valve 6 results in a change of the fuel pressure in the first and second chambers of the equal pressure valves 7, and hence in a modification of the pressure difference prevailing at the fuel-metering valve.

What is claimed is:

1. A fuel injection system for mixture compressing, externally ignited internal combustion engines, including:

a. a plurality of fuel injection valves equal in number to the number of engine cylinders;

b. a fuel distributing unit having a plurality of fuel metering valves equal in number to the plurality of fuel injection valves;

c. a plurality of pressure valves equal in number to the plurality of fuel injection valves;

d. means connecting each of said pressure valves to a respective one of said fuel injection valves; and e. further means connecting each of said pressure valves to a respective one of said fuel metering valves, wherein:

i. each of said pressure valves includes means producing a defined space, and a flexible member which divides the defined space into first and second chambers;

ii. the flow cross section of each of said pressure valves can be changed by its flexible member;

iii. the pressure in the first chamber of each pressure valve is the fuel pressure prevailing downstream of its respective fuel metering valve, said prevailing pressure acting on the flexible member in an opening direction of the pressure valve;

iv. said connecting means and said further connecting means for each pressure valve define with their respective pressure valve a fuel flow path from the fuel metering valve to the fuel injection valve associated with the respective pressure valve;

v. the fuel metering valves determine the fuel quantity flow through the various flow paths by jointly changing their flow cross section;

vi. at least one of said pressure valves is embodied as an equal pressure valve and at least one of said pressure valves is embodied as a differential pressure control valve;

vii. the pressure in the second chamber of the differential pressure control valve is the pressure prevailing upstream of the fuel metering valves;

viii. means are provided so that the first chamber of the differential pressure control valve communicates with the second chamber of each of said equal pressure valves; and ix. fuel metering occurs at a constant pressure difference due to (i) – (viii).

2. The fuel injection system according to claim 1, wherein the differential pressure control valve is adapted to change the pressure difference prevailing at the metering valves in dependence on engine parameters.

3. The fuel injection system according to claim 1, wherein each of said equal pressure valves is a flat seat valve having a common diaphragm as its flexible member.

4. The fuel injection system according to claim 1, further including a spring having a low spring constant, wherein the differential pressure control valve is a flat seat valve having a diaphragm as its flexible member which is loaded in an opening direction by said spring.

5. The fuel injection system according to claim 1, wherein each of said equal pressure valves and said differential pressure valve is a flat seat valve having a common diaphragm as its flexible member.

6. The fuel injection system according to claim 1, wherein a housing, an intermediate plate, a bottom cover and means for joining said housing, said intermediate plate and said bottom cover into an assembly are provided, wherein said housing, said intermediate plate and said bottom cover provide in assembly the means for producing the defined space of each pressure valve, the means (ix) and a bore into which the fuel metering valves are mounted, and wherein said housing includes the further connecting means of each pressure valve.

7. The fuel injection system according to claim 1, further including a spring having a low spring constant, and an electromagnetic assembly, wherein the differential pressure control valve is a flat seat valve having a diaphragm as its flexible member, wherein said spring is disposed on one side of said diaphragm for loading said diaphragm in an opening direction, and wherein said electromagnetic assembly is disposed on the other side of said diaphragm, said electromagnetic assembly being adapted in response to an engine parameter to change the force exerted by said spring.

* * * * *